US006662520B1

(12) United States Patent
Nelson

(10) Patent No.: US 6,662,520 B1
(45) Date of Patent: Dec. 16, 2003

(54) SUB-RIGID FAST-FORM BARRIER SYSTEM

(76) Inventor: Thomas Page Nelson, 96 Cabot St. Apt. #4, Portsmouth, NH (US) 03801

( * ) Notice: Subject to any disclaimer, the term of this patent is extended or adjusted under 35 U.S.C. 154(b) by 0 days.

(21) Appl. No.: 09/665,272

(22) Filed: Sep. 19, 2000

Related U.S. Application Data

(63) Continuation-in-part of application No. 08/082,570, filed on Jun. 28, 1993, now abandoned.

(51) Int. Cl.[7] ..... E04C 3/36

(52) U.S. Cl. ..... 52/732.2; 52/731.3; 52/731.5; 52/481.1; 52/508

(58) Field of Search ..... 52/732.2, 731.3, 52/731.5, 656.1, 348, 762, 481.1, 729.1, 508

(56) References Cited

U.S. PATENT DOCUMENTS 3,819,143 A * 6/1974 Butts et al. ..... 249/33
4,177,968 A * 12/1979 Chapman ..... 249/211
4,448,004 A * 5/1984 Thorsell ..... 52/241
4,693,047 A * 9/1987 Menchetti ..... 52/664
4,811,539 A * 3/1989 Menchetti ..... 52/486
4,858,407 A * 8/1989 Smolik ..... 52/481
5,058,354 A * 10/1991 Menchetti ..... 52/486
5,417,023 A * 5/1995 Mandish ..... 52/348
5,848,512 A * 12/1998 Conn ..... 52/729.1
6,076,323 A * 6/2000 Chiu ..... 52/262
6,199,336 B1 * 3/2001 Poliquin ..... 52/489.1

* cited by examiner

*Primary Examiner*—Carl D. Friedman
*Assistant Examiner*—Jennifer I. Thissell
(74) *Attorney, Agent, or Firm*—Brian S. Steinberger; Law Offices of Brian S. Steinberger, P.A.

(57) ABSTRACT

The invention disclosed herein is remarkable in its simplicity and promises wide commercial application as the labor costs for construction become increasingly prohibitive. The extraordinary absence of nails, screws, bolts, welds or any other fastening device allows these barriers to compete with many conventional barrier systems, such as those employed for fencing, vehicular trailer beds, removable stages, and scale models or toys of all fabrications mentioned plus many more. In this age time is money and the erection speed this barrier system offers may well revolutionize conventional "post and beam" framing. The invention is specifically aimed at eccentric beam loading where barriers must be economically fabricated to withstand hurricane force winds, earthquake reactions, or liquid concrete pressure in a sub-rigid manner. The Fast-Form System will offer insurers building products that will protect their interests for any and all applications. When the barriers disclosed herein are utilized for concrete formwork, contractors will have a new option that embraces standard building products, with barrier fabrication accomplished in half the time of the systems that precede it.

24 Claims, 5 Drawing Sheets

SUB-RIGID FAST-FORM BARRIER SYSTEM

RELATED DOCUMENT

This application is a continuation in part of application Ser. No. 08/082,570 filed Jun. 28, 1993 in the U.S. Patent and Trademark Office, now abandoned.

FIELD OF THE INVENTION

"Joining" is the art form that this invention advances; with the joining of standard building materials, for manufacturing mass produced, efficient, commercial barriers, as the main objective.

Relative to the application described herein, the inventor has a diversified background and experience in the industrial art of joining building materials.

The ratiocinative combinatory logic is rooted in the inventor's knowledge and thirty years of experience in working with concrete form design and application. Formwork must be assembled quickly in a rigid or sub-rigid composition, maintained in a pre-engineered and static fabrication during concrete placement and subsequently dismantled and stockpiled for future multiple uses.

While developing the ratiocinative interlocking barrier as a new concrete forming system, it became apparent that the post and beam type framing of this invention would offer an improved method for framing and sheathing houses or the like.

While modeling the fast-form barrier system for housing; walls, floors, and roof, other versatile applications became apparent. Through experimenting with variations of: elements; parameters; and cubic content for super-ordinate beam members, subordinate beam members, and facer members this system displayed wide versatility in many low-rise building applications.

In the past, the inventor has owned a fabrication shop established for the purpose of building utility trailers and the like. Through professional experience in the mechanical art of fabricating utility trailers, the invention claimed herein offers economical advances in trailer frame and bed applications.

While experimenting with various barriers, it became apparent that the modality of this system of applying variations of; elements, parameters, and cubic content offers a new way to build furniture, bridges, fences, platforms, docks, billboards, and many other barriers that those schooled in the art will easily recognize.

The super-ordinate beam members guide the systematic fabrication of barriers without the use of nails, screws, or other fastening devices.

When produced as scale models, the invention further offers a valuable addition to children's toys, to occupational therapy, and to play houses of all sizes. Such models may also be used for teaching those not skilled in the art of building low-rise structures (such as houses), concrete forms, trailers, fences, barricades, platforms, and other barrier construction.

TECHNICAL FIELD

The Sub-Rigid Fast-Form Barrier System embodies the specifics of numerous classes and subclasses including;

US Class 52/subclass 7, (moveable stage combined with a static structure) 14, 49, (moveable or removable closures), 81.2 (Frame in which a node of the structural network members is particularly designed to hold the members together and transmit forces), 143,256 (fences), 312 (supports), 403 (joints and connections), 425 (shaping mating parts for re-assembly in different positions), 459 (bridger strip covering two abutted panels), 470,474,479,729.4 (an I-beam comprising wood and metal), 731.3 (having interlocking feature), 737.1 (for load-bearing uprights), 745.05 (barrier construction), 745.06,745.08,745.09,745.19,764 (Structure wherein the facer retaining means includes a camming means), 768, 772, 775,781;

US Class 249/subclass 1,6,25,26,28,32,33,44,47,102,145, 163,184,186,190,216, 219.1,219.2,428, US Class 029/subclass 897 (structural member making), US Class 256/subclass 24,73, US Class 446/subclass 108,476, US Class 280, US Class 119/subclass 516,522,525,523,519, US Class 108/subclass 59, US Class 182, US Class 108.

International classifications B32B, B32B7/00, B32B21/00, B32B33/00 E04B, E04G, E04H, E04B1/00, E04B2/00 E04B5/00, E04B7/00, E01D15/00, A63H33/00H, 04H, 06C, 010C.

DESCRIPTION OF PRIOR ART

Prior art teaches variations including many devices, generally stamped or roll-formed metal gadgets, which attach to the main framing members for the purpose of securing floor joists, roof rafters, stair runners and such, and they require many fasteners to complete the frame and cover.

Prior art includes steel-framed buildings composed of vertical main steel columns laterally braced with an outer layer of horizontal side wall girts (ribs), supporting roof beams with perpendicular roof purlins which also act as ribs that receive generally lightweight metal sheets to complete an enclosure such as produced and marketed by Butler Building Systems, based in Kansas City. This system is layered, and each layer is attached with a plurality of pre-punched or pre-drilled holes that receive a plurality or removable bolts, screws, and fasteners.

Prior art includes open web joists with many variations of attachments.

Prior art includes many methods of attachment including nails, screws, bolts, clamps, welds, wedging, compound wedging, pinning and seating.

Systems of prior art teach a framing method of layering that consists of two or more layers of installed components in order to achieve a frame and cover with layers extending beyond the limits of the load gathering dominant beam member.

Prior art teaches engineering for axial loading, point loading, dead load, eccentric loading, distributed beam loading and many other engineering factors relevant to the competency of the invention described herein.

Prior art includes mortise and tenon joints that typified $19^{th}$ century and earlier wood framing in buildings such as houses and barns. This basic post and beam type of framing featured heavy hewn wooden posts and beams mortised to receive perpendicular sub-members which had tenons formed on either end that fit the mortised openings in the main members. The mortise and tenon method was useful because the composite members did not need to be the same shape, as only the mortise and tenon joints were usually a standard size.

The following construction practices are derived from the Library of Congress Cataloging in Publication Data, Main Entry under title: Time-saver standards for Architectural design data, Sixth edition, Copyright 1982 by McGraw-Hill, Inc. printed in the United States of America and describes prior art forms.

a) Prior art includes "balloon frame construction" which employs smaller, lighter and more frequent standard sizes of sawn lumber implemented in the early $20^{th}$ century as a result of mass production and the industrial age.

b) Prior art includes "platform frame construction" (also known as eastern framing) which employs conventional lumber framing, as well as modular components such as plywood, and is considered a "light wood framing" method.

c) Prior art includes "plank and beam" more commonly known as "post and beam" construction which historically incorporates heavy timbers as well as steel beams. This system teaches connections using heavy bolts or screws and, at times, utilizes steel plates at the connections that may be substituted with new seating gadgets requiring a plurality of nails bolts or screws.

Platform frame construction is a current conventional method of wood-frame construction in the United States. Those with knowledge of the art, and who understand and know it today would construct a sill on top of a foundation, which is usually bolted to the concrete or block foundation, with floor joists incorporated in a box frame on top of said sill and with floor joists and box frame being connected to one another plus the sill, historically using an abundance of 16D nails or a larger wire size such as 20D nails, with decking such as modular structural sheets on top of the floor joists, connected to said floor joists with an abundance of either nails or screws, and then a new sill, called a sole plate, is placed, and attached with nails or screws, on top of the first floor decking at the exterior edges, on top of which vertical studs are attached, with nails or screws, and then capped with a double top plate, which in turn is nailed to the vertical studs below, on top of which another floor may be framed in the same manner as the one below, with the top plate assuming the position of the sill, with as many walls and floors being added as is structurally safe and with a roof, comprised of rafters and cover, added to the top which is framed in a manner, that generally requires a strategic coping of the rafter ends in order that they may fit a sill plate on the top floor as they angle toward a peak where they join an opposite roof rafter at the peak, where said rafters are held together with nails or screws.

The skeleton or framework for all these previous methods historically receives a skin of boards, or modular sheathing, which is fastened to the frame with a multitude of nails, screws, bolts or other fastening devices.

Prior art teaches variations added to these frames which include many new devices generally stamped or roll formed metal gadgets that attach to the main framing members for the purpose of securing floor joists, roof rafters, stair runners and the like, and they require many fasteners to complete the frame and cover.

Prior art includes toy buildings such as "Lincoln Logs", based on log cabin framing which simply notched the end of logs so that they would interlock at the corners "Lincoln Logs" were patented in the early 1900's by the son of famous architect Frank Lloyd Wright.

None of the prior art searched by the inventor, reviewed, or found on the market displays a method similar to the Ratiocinative Interlocking Fast-Form Barrier System.

The inventor conducted an informal prior art search, and the inventor is intimately familiar with the prior art. Following are typical examples of the patented prior art known to the inventor and appreciated as references for the invention of this versatile sub-rigid fast-form barrier system.

U.S. Pat. No. 3,748,806 entitled "Concrete Wall Form" granted to Vytautas P. Talandis on Jul. 31, 1973, U.S. Pat. No. 3,819,143 entitled "Formwork for Concrete Walls" granted to Ernest O. Butts and John S. Hall, on Jun. 25, 1974, U.S. Pat. No. 3,452,960 entitled "Concrete Wall Form With Load Gathering and Distributing Members Therefor" granted to G. F. Bowden on Jul. 1, 1969, U.S. Pat. No. 4,177,968 entitled, "Concrete Formwork Soldier" granted to David Chapman on Dec. 11, 1979, U.S. Pat. No. 4,514,950 entitled; "Building Framing System & Method" granted to Albert A Goodson Jr. on May 7, 1985, U.S. Pat. No. 4,325,532 granted to Blank for "formwork System" on Apr. 20, 1982, U.S. Des. Pat. No. D-236, 447 granted to Carl Nienddorf for "Metal Form Unit" on Aug. 26, 1975, U.S. Pat. No. 3,474,582 granted to Wah et al for "Building System" on Oct. 28, 1969, U.S. Pat. No. 3,461,638 granted to H A Balinski for "Structural Member" on Aug. 19, 1969, U.S. Pat. No. 5,715,462 granted to George P. Buers for "Steel-frame system and member" on Feb. 10, 1998, U.S. Pat. No. 5,956,919 granted to Robert G. McCracken for "Spanning member with convoluted web and C-shaped flanges" on Sep. 28, 1999, U.S. Pat. No. 5,890,333 granted to Richard Boroviak for "Concrete form" on Apr. 6, 1999, U.S. Pat. No. 6,079,173 granted to Waalkes, et al. for "Knock-down portable partition system" on Jun. 27, 2000, U.S. Pat. No. 6,092,340 granted to David G. Simmons for "Structural framing system and method of assembly" on Jul. 25, 2000, U.S. Pat. No. 5,195,282 granted to Logan E. Campbell for "Low cost-modular element housing" on Mar. 23, 1993, U.S. Pat. No. 4,435,940 granted to Jeanne A. Davenport et al for "Metal building truss" on Mar. 13, 1984, U.S. Pat. No. 4,485,598 granted to Eustachio Guardiani for "Prefabricated elements and rooms for the quick construction of buildings and building works in general" on Dec. 4, 1984, Int. Patent WO9850645 granted to Erkki Huppunen (FI) for "House Framing and Apparatus for Manufacturing such framing" publication date Nov. 12, 1998, Int. Patent WO9919582 granted to Thomas Donald Harrison (AU) for "Barriers and Barrier Systems and Components For Barrier Systems" publication date Apr. 22, 1999, Int. Patent WO9959830 granted to Pierce Phillippi Randsome et al. for "Vehicle Trailer Frame Cross Member/Suspension Assembly Mount" publication date Nov. 25, 1999, Int. Patent JP11093406 granted to Takashima Takuji et al. for "Concrete Formwork and Manufacture Thereof" publication date Apr. 6, 1999.

None of the prior art inventions singly or in combination meet all of the objectives established by this versatile interlocking barrier system.

NON-OBVIOUS IMPROVEMENTS AND APPLICATIONS

Most of the prior art applications that have some similarity to the ratiocinative and interlocking Sub-Rigid Fast- Form Barrier System are found in formwork applications, and a review of the following examples display wide differences.

Typical prior art includes U.S. Pat. No. 3,452,960 by Bowden who teaches a method of formwork that requires a multitude of screws and wedge devices in order to complete the four-layered composite. The barrier herein accomplishes the same result with three layers. Today every nail, screw, nut&bolt, and compound wedge impact the variable cost of labor. These supernumeraries expose Bowden's method as labor intensive for today's market. We claim no supernumeraries. Bowdens composition requires fasteners through the plywood to hold all members in place and is designed to be a rigid structure. We claim a sub-rigid structure. The main load-gathering beam of Bowden's invention is designed to be produced from sheet metal only, thereby limiting strength and integrity. The ratiocinative combinatory logic claimed in this application allows any structural element to be manufactured as a super-ordinate beam. Furthermore Bowden's beam works only in a vertical stance in order to retain the tie-rods that are the main objective of Bowden's beam. Bowden's main beam is far inferior to the super-ordinate beam of the invention herein. The super-ordinate beam herein is primarily designed to provide a sub-rigid method of improving housing to withstand natural disasters such as hurricanes. Furthermore, the openings Bowden provides for the horizontal studs are one dimensional, as they simply allow sub-beams to pass through and be seated within the main beam and against the elongated bearing plates invented by Bowden. These openings do not resemble the multi-functional ratiocinative breech and chamber openings of this invention.

While Bowden teaches a method of extending transverse sub-members in repetition with the ability to overlap and stabilize a plurality of collateral vertical wales, he does not teach a method of ease and efficiency for extending his materials collaterally in a vertical direction. The versatile barrier system herein greatly advances the method of extending collateral materials in two directions using ratiocinative combinatory logic not evident in Bowdens invention. Bowdens main beam members are designed to work as vertical wales only. The studs are seated and backed up by the waler, unable to function when wales are horizontal and said studs are vertical. The invention herein claims a versatile barrier that will function successfully on any plane with perpendicular beams that support each other in any direction.

Bowdens system is restricted to formwork applications and does not display the cubic content desired for permanent barriers. Bowdens system is not capable of housing the sheathing within the parameters of the main load-gathering member and does not display a method of attaching sub-members such as the material interface of the invention herein.

Bowdens system does not complete formwork application and removal with the ease, versatility, and competence of the system claimed herein. The multi-functional breech and chamber beam, which is the highlight of this new invention, goes well beyond Bowdens load-gathering beam which highlights a way of securing tie-rods typical to concrete formwork.

Another example of prior art is U.S. Pat. No. 4,177,968 by Chapman, Chapman's only obvious advancement of Bowden's formwork for concrete is that it offers a uniform modular "reversible" main beam. However the advancement ends there and the functionality while superior to Bowden's, suffers from all the same deficiencies stated above in relation to Bowden's.

Chapman and Bowden employ a combinatory logic that requires three different beam types in support of the plywood.

Bowden and Chapman both lack the ability to remove plywood modules, or to remove subordinate beams with ease.

Bowden and Chapman display a system that requires seven to nine man-hours per 100 square feet to erect (as set forth in Means Construction Cost Data). The barrier system claimed herein is capable of erecting 100 square feet in 30 minutes by one person. Furthermore, it would take a minimum of one man-hour to disassemble and stockpile Bowden or Chapmans 100 sq.ft. of reusable forms whereas 100 sq.ft. of the fast-form barrier may be disassembled and stockpiled in ten to fifteen minutes by one person.

U.S. Pat. No. 3,748,806 by Talandis teaches a system of upright legs with holes for traversing tubular sub-members, which must be secured with wedges. Talandis's method lacks versatility. The Talandis method is not very practical for formwork or any other application when given the modular materials of our time. The Talandis system does not extend collaterally in two directions. Furthermore the Talandis system is restricted to formwork applications and does not display the cubic content desired for diversified barriers. The Talandis system does not complete formwork application and removal with the ease and competence of the advanced system claimed herein.

U.S. Pat. No. 3,819,143 by Butt's and Hall teach an innovative method of utilizing steel joists spaced with spanner bars that support a preferred surface of plywood and this system works well as an elevated slab form that may be removeably installed. However, this is the only practical application where the innovations may be applied.

Butt's and Hall's system suffers from a stockpile of many parts and pieces, and while bar joists offer strength and lightness, they suffer from lack of compact efficiency and extended stability.

While this system is designed to support concrete, it is not feasible for use as a rigid or sub-rigid wall as it displays no method of sheathing or retaining the plywood surface without the inclusion of screws, nails, bolts or the like.

The improvements, advancements, and new discoveries this invention offers include;

a.) A sub-rigid composition unparalleled by prior art which is easily transformed in to a rigid composition, b.) A structural barrier with no nails, screws, bolts, welds, wedges, or other fastening devices, c.) A super-ordinate breech and chamber beam that is multi-functional inasmuch as it: superimposes subordinate barrier members, it supports the face loading of subordinate members, it supports axial loading of extended members as well as calculated perpendicular loads, it laterally braces subordinate members, it interlocks and fastens subordinate members, and it provides a portion of the barrier face, d.) A ratiocinative composition that exploits elements latent capabilities thereupon employing advanced combinatory logic, e.) An extremely versatile form of building barriers that will compete with methods for fabricating; buildings (such as houses), concrete forms, trailer beds, fences, barricades, boardwalks, boat docks and many other barrier applications, f.) A method of friction fitting to interlock like elements, g.) A method of cramping or compressing to interlock unlike elements, h.) A method of providing an all-purpose building beam that superimposes all structural elements and will also house the infrastructure, i.) A barrier that is completely engineered and may have loading charts for each member, and the composition as a whole.

The invention herein teaches ratiocinative combinatory logic relative to variations of elements, parameters, and cubic content that displays an exciting array of new barrier fabrications.

The super-ordinate breech and chamber beam derived from the ratiocinative combinatory logic of this invention promises a wide variety of future applications that may well revolutionize the way beams are employed, transforming standard seating beams into penetrated interlocking retainer beams.

Improvement over prior art lies in many obvious and non-obvious areas. The most significant improvement is the time saved in the integration of three main building components for a sub-rigid barrier.

Another improvement lies in the method of integration requiring: only an inverter, such as a hammer to completely assemble a sub-rigid barrier.

Another improvement addresses the threat of natural disasters such as hurricanes, tornadoes, and earthquakes as this system is sub-rigid with the ability to calculate implied forces and pre-engineer components to withstand such forces with calculated tie rods through super-ordinate beam/columns, that go right to the roof.

Another improvement permits those not experienced in the art of building barriers (horizontal, vertical or diagonal) to accomplish complete installations themselves with minimum aid.

Another improvement is the ability to complete a static sub-rigid barrier without fasteners. The super-ordinate beam, with breech and chambers, requires only a beam location. From there the super-ordinate beam acts as the project manager, as it dictates the systematic fabrication of subordinate components.

Another improvement of the invention is that any subordinate member may be quickly and easily removed for any reason, and reinstalled or replaced as required.

The previous improvements lend themselves well to concrete form systems. This invention offers diversified new methods for integrating standard construction components in a sub-rigid versatile concrete form system capable of efficiently installing concrete house foundations or nuclear reactor containment walls.

Further economic advantages offer the construction contractor a super-ordinate beam designed to interlock standard structural supplies, such as nominal 2×6 lumber beams and 4×8 sheets of plywood, said supplies being those most commonly used for all sorts of construction barriers. With said fast-form super-ordinate beams a contractor can quickly assemble and disassemble any type of temporary or permanent barrier or enclosure he may need, from formwork to street barricades.

The invention also offers easily calculated beam loading charts that are all computer based for economical and safe results.

The simple method and design of the invention allows for those not experienced in the art of assembling formwork to quickly, easily, and safely conduct the assembly or disassembly procedures without the need for extensive supervision.

Further, this barrier system offers calculated axial loading that will work in concert with beam loading.

Another improvement, over prior art, is based on the need for form-builders using basic forming materials, such as structural lumber framing materials and standard HDO plywood panels, to access the inside of the formed area for any number of reasons, prior to concrete placement, the breech and chamber beam of this invention allows for access.

Further, the breech and chamber super-ordinate beam, with a minimum of subordinate beams, offers a frame on which ironworkers may pre-fabricate reinforcing steel compositions away from the intended location in a safe and simple way.

Following said pre-fabrication, the fast-form frame with prefabricated reinforcing attached may be flown into place with a crane or other hoisting device, set and stabilized, the fast-form system may then be completed by the carpenters in rapid succession for concrete placement. This innovation has great timesaving implications for the contractors that are faced with impacted scheduling for coordination of disciplined crafts as well as quality control procedures. Prior art does not display these advantages.

As new technology teaches more mechanized ways of handling prefabricated modules, this new invention offers great economical advantage over prior art by offering the ability to easily remove any piece or part, at any time, without being encumbered by fasteners.

Contractors today are obliged to order complete panelized form systems in order to meet schedules. The versatile barrier system of this invention will offer the option to use standard lumber and plywood and to rent or purchase only the breech and chamber super-ordinate beams of this invention.

The inventor has referenced the following industry manuals, plus other support issues, in the course of designing this invention, and they include:

Time-saver standards for Architectural design data, Sixth edition. Copyright 1982 by McGraw-Hill, AISC, Manual of Steel Construction, Formwork for Concrete by M K Hurd, Fourth Edition, prepared under direction ACI Committee 347, APA, The engineered Wood Association, Residential and Commercial Design/Construction Guide, Form No. E30Q/Revised November 1998/0400, ENR, Engineering News-Record weekly issues, Means Construction Cost Data, annual editions, Sweets International Building Products 1995, Websters Third New International Dictionary.

Publications by manufacturers of prior art include:

Econolite or Superstud™ steel forms for concrete construction by EFCO (Economy Forms Corporation of Des Moines Iowa), Gates Commercial Forming Systems, by Gates and Sons, Inc., 90 South Fox Street, Denver, Colo. 80223, PERI Formwork and Scaffolding, PERI GmbH, Export Division PO Box 1264, D-7912 Weissenhorn, Germany, Doka International, Deutsche Doka, Schalungstechnik GmbH, Frauenstrasse 35, D-82216 Maisach/Germany.

OBJECTIVES

Various objectives of the Sub-Rigid Fast-Form Barrier System are to;

provide a versatile sub-rigid barrier system that is completed quickly, easily, efficiently and inexpensively, develop programmed computer assistance for pre-engineering the systematic production of manufactured beams of all shapes and sizes, to act as super-ordinate beams, chart calculus of individual materials through computer programming and employ this information in the determination of compatibility of materials, for fast-form barriers, introduce super-ordinate multi-functional breech and chamber beams that work in concert with subordinate beams to compress-ably sheath and inter-lock modular facers, provide an archetype of the lowest common denominator in the fabrication of composite architectural surfaces, provide improved beams advancing the art of increasing strength while decreasing size and weight, provide a barrier with high strength components compacted to minimum parameters and cubic content, remove-ably inter-tie a barrier in a through-bond manner without the use of nails, screws, bolts or other standard fasteners, provide modular barrier compositions that compute in feet and inches or metrics or any other measuring system, produce a barrier that may be completed faster than any prior barrier employing like elements, produce a semi-rigid barrier capable of load-bearing responsibilities, produce a barrier that may be transformed to completely rigid by including fasteners, produce a ratiocinative structural barrier acceptable if not embraced for wide commercial application, explore latent ability of elements for the fast-form barrier, with the advantage of providing variations in the fast-form barrier system, apply ratiocinative combinatory logic to structural elements in as many commercial applications as possible, exploit variable components including materials such as standard steel beams, aluminum beams, roll formed steel, structural lumber products, structural plywood products, structural glue-lam products, etc. for use as a fast-form barrier, exploit the materials and techniques of our times, for the purpose of completing a versatile fast-form barrier, employing those products readily available in any local market, apply ratiocinative combinatory logic in structural forms from scale model toy houses to full size buildings and the like, join structural elements in a trizonal barrier composition void of supernumeraries, provide a pre-engineered computerized method of composing and joining three standard structural building products in the fabrication of a sub-rigid yet static barrier, eliminate nails, screws, bolts, and the like that impact the cost of labor in prior art, increase the functionality of standard building products through the process of productively removing cubic content rather than adding gadgets, provide super-ordinate breech and chamber beams capacitated for beam loading, provide super-ordinate breech and chamber beams capacitated for axial loading, provide super-ordinate breech and chamber beams manufactured as double or triple beams, for the purpose of supporting heavier loads as a beam or as an axial loaded column, provide a new box splice system for super-ordinate breech and chamber beams for the purpose of easily extending super-ordinate beams, provide super-ordinate breech and chamber posts or beams that systematically locate sub-ordinate beams, provide super-ordinate breech and chamber posts or beams that systematically fasten subordinate beams, provide super-ordinate breech and chamber posts or beams that systematically laterally brace sub-ordinate beams, provide super-ordinate breech and chamber posts or beams that systematically arrest and fasten sheathing facer, provide super-ordinate breech and chamber posts or beams that systematically bridge and separate abutting facers, provide super-ordinate breech and chamber posts or beams that, in harmony with subordinate beams, systematically unfasten facer for easy removal and replacement, provide modular facers that act as a sub-ordinate structural components available for calculated axial loading for support of extended superstructure, provide subordinate beams capacitated for beam loading, provide subordinate beams capacitated for axial loading, provide subordinate beams that fasten super-ordinate beams in an interlocked location, provide subordinate beams that laterally brace any super-ordinate beams without fasteners, provide subordinate beams that unfasten any super-ordinate beam, for easy removal and replacement, provide subordinate beams that systematically fasten modular sheathing in a superjacent method, provide subordinate beams that systematically locate and carry infrastructure along the open horizontal plane of said subordinate beam for a house or the like, provide modular facers that systematically locate super-ordinate posts or beams, provide modular facers that arrest superjacent to super-ordinate and subordinate beams, in modular square compositions, provide pre-fabricate modular panels that can be easily joined to identical modular panels of any modular size, provide pre-fabricated modular panels that may easily interlock identical modular panels of any modular size at a staging area, and further be transported to location and set with a crane, provide new techniques used in the manufacture of fast-form barriers that include computer assisted laser cuts, precise metal pressing, precise gang sawing, precise coping, and the like, provide super-ordinate beams that may attach to super-ordinate posts through ratiocinative cutting and splicing without the use of supernumeraries, improve methods of manufacturing standard components for building a house, so that a house may be produced for commercial distribution at lower labor costs, improve methods of manufacturing standard components for building any housing residences, businesses, schools, offices, industry, commerce or any other occupation requiring shelter so that said shelter may be produced for commercial distribution at lower costs, improve methods for multi-story barrier applications, improve methods for wall framing systems employing the post and beam technique, improve methods in multi-story applications employing a platform framed, floor-by-floor technique by installing super-ordinate beams horizontally with subordinate beams vertical, improve methods in multi-story applications or single story applications with fast-form barriers as the roof framing system, provide a ratiocinative sub-rigid prefabricated housing method for rapid deployment that may be used in areas where shelter has been devastated by flood, hurricane, tornado, earthquake or other natural or unnatural disasters, provide a ratiocinative sub-rigid prefabricated housing method for rapid deployment that may be used for military housing that is temporarily bivouacked provide a ratiocinative sub-rigid tie down method for housing which may be pre-engineered and easily reinforced in order to provide calculated resistance that will insure against hurricane force winds and the like, provide improved methods of building a house or shelter, in order that those not schooled in the industrial art of building may easily carry out said industrial art, advance methods of building concrete formwork, co-ordinate methods of building concrete formwork with house framing members whereby this invention may be employed using the permanent housing materials for the purpose of building concrete foundation walls prior to recycling said materials as house framing and sheathing, advance methods of re-moveably installing concrete formwork, in order that areas confined within the enclosure that formwork provides for concrete, may be easily accessed by a man and easily reformed, for removal of debris, prior to concrete placement, advance methods of re-moveably installing concrete formwork, in order that areas confined within the enclosure that formwork provides for concrete, may be easily accessed by a man and easily reformed, for installation of a through-wall block-outs or sleeves, prior to concrete placement, advance methods of re-moveably installing concrete formwork, in order that areas confined within the enclosure that formwork provides for concrete, may be easily accessed by a man and easily reformed, for installation or repairs to reinforcing steel, prior to concrete placement, improve methods of re-moveably installing concrete formwork, in order that areas confined within the enclosure that formwork provides for concrete, may be easily accessed by a man and easily reformed, for installation of embedded structural plates, prior to concrete placement, improve methods of re-moveably installing concrete formwork, in order that areas confined within the enclosure that formwork provides for concrete, may be easily accessed by a man and easily reformed, for installing, for repairing, or for removing any number of variables that are integral to completing formwork for concrete structures, improve methods of re-moveably installing concrete formwork, in order that attaching very heavy embedded structural plates may be accomplished by positioning a super-ordinate beam for the purpose of attaching said heavy embedded structural plate directly to said super-ordinate beam, at the location intended for the plate to be embedded, therein offering the plate a structural surface as well as a structural leg that is compatible with said plate. Note: Historically form faces, at any given point, do not possess the cubic content that a heavy embedded plate possesses, such as those embedded in power plant concrete structures, improve methods of re-moveably installing concrete formwork, in order that areas confined within the enclosure that formwork provides for concrete, may be easily accessed by a man and easily reformed, at any point, for installation of electrical pipes and outlets, prior to concrete placement, improve methods of re-moveably installing concrete formwork, in order that every one of the three major structural components involved in the fast-form barriers may be remove-ably inserted or reinserted into the barrier at any time, prior to concrete placement and after concrete has hardened, improve methods of re-moveably installing concrete formwork, in order that the super-ordinate beam of fast-form, which houses a tie-system, holds opposing concrete forms in place and together, while liquid concrete is placed, and may remain in place, after sub-members and plywood are removed, for the purpose of underpinning the next lift of forms in multistory applications, improve methods of re-moveably installing concrete formwork, in order that the super-ordinate beam of fast-form barriers, that innovatively house the tie-system, may remain in place after sub-members and plywood are removed, for the purpose of retaining scaffolding used for any additional works needed to be carried out on the concrete wall surface, improve methods of re-moveably installing concrete formwork, in order that the super-ordinate beam of fast-form, may easily, quickly, and safely connect and disconnect staging brackets used for staging needed for work above the ground, improve methods of re-moveably installing concrete formwork, in order that staging may integrate with formwork, employing ratiocinative components, in order to reduce co-mingling of materials, improve methods of re-moveably installing concrete formwork, in order that staging may integrate with formwork, employing ratiocinative components in order to improve the safety required for such staging, improve methods of re-moveably installing concrete formwork, in order that the super-ordinate beam of fast-form, may easily quickly and safely connect and disconnect alignment braces used for aligning formwork before and during concrete placement, improve methods for concrete formwork, in order that the fast-form system may employ the super-ordinate beams vertically or horizontally for concrete wall installations and may act as the super-ordinate beam for elevated slab installations, improve methods of building a barricade, in order that certain barricades may be produced for commercial distribution, that offer a removable solid surface for barricades that is quickly and remove-ably installed, advance methods of building a fence, in order that certain fences may be produced as fast-form barriers, improve methods of building a fence, in order that those not schooled in the industrial art of fence building may easily carry out said industrial art, advance methods of building trailer beds, in order that trailer beds may be produced using the fast-form barrier system, for commercial distribution with economic improvements in utility trailers, advance methods of building trailer beds, in order that trailer beds may be produced using the fast-form barrier system, for commercial distribution with economic improvements in long haul heavy-duty flatbed trailers, advance methods of building trailer beds, in order that trailer beds may be produced using the fast-form barrier system, for commercial distribution with economic improvements in farm trailers, improve methods of building trailer beds, so that those not schooled in the industrial art of trailer bed building may easily carry out said industrial art, provide a fast-form barrier method of building a temporary or permanent bridge that may be quickly and easily removed, provide a fast-form method of building a temporary or permanent boardwalk that may be quickly and easily removed, provide a sub-rigid fast-form method of building a boat dock that may be easily removed in the winter months when and where ice flows historically ruin docks, provide fast-form scale models, designed to provide advance knowledge to those who will be employed in building life size fast-form barrier system buildings, provide various fast-form scale models, for the purpose of providing children with advance knowledge, employed in building life size buildings, provide various fast-form scale models, for the purpose of providing amusement for children or adults, that may assemble and disassemble fast-form applications at their leisure, provide various fast-form scale models, for the purpose of providing occupational therapy for those mentally impaired that may assemble and disassemble fast-form applications, designed to match certain abilities, provide a fast-form method of quickly and re-moveably building a stage for outdoor theatre, dance, or ceremony, provide a fast-form method of quickly and re-moveably building a tower with an observation platform, provide a fast-form method of quickly and re-moveably building a billboard, provide a fast-form barrier method of quickly and re-moveably building temporary or permanent pens for animals,

BRIEF SUMMARY OF THE INVENTION

The Sub-Rigid Fast-Form Barrier System has been advanced for the purpose of reducing man-hours in barrier installations. The process developed from the inventor's background in concrete form design. It became apparent that this invention could be produced for wide application with safety and strength insured through the help of virtual reality computer programs. Experimentation based on a reduction of components size, shape, number, and cost, has propelled this invention.

This new system is based on using standard materials, for the purpose of providing efficient, structurally sound, framing and sheathing.

When fixed costs reduce variable cost, and when fixed cost is not significantly increased while variable costs are dramatically decreased, an economical advantage for the average consumer results.

While we have experienced many advances in the development of our natural resources we have not seen many broad-based advances in their application. Examples of advances in development of our natural resources include; the production of new plastics, structural aluminum, and structural plywood, along with the development of stronger and lighter steel shapes. While these advances have been employed as aids and have allowed for modular advances in sheathing, roofing and the like no significant changes have occurred that make the framing and sheathing of buildings significantly less complicated and significantly faster to produce.

The invention herein displays an expansion of ratiocinative combinatory logic that reduces manual labor significantly in joining typical building products. This invention goes steps beyond simply reducing labor, as it reduces supervision and planning, by allowing the modular components to dictate their location and function in a tangible result.

Ratiocinative combinatory logic involves producing new standards for beams, beams that are historically offered as steel shapes, which allow loads to sit on their face or on their end. This invention, through reduction in cubic content, allows hot rolled structural steel beams, cold roll-form metal beams, aluminum beams, plywood beams and the like, to be eligible for more functions. The determination of these functions is derived from calculating the latent potential of each modular element. Calculations involve calculus of individual building components, with regards to those components basic elements, parameters, and cubic content.

This invention, employing advanced production methods, teaches an innovative efficient way to join three (or more) mass structural elements, employing superjacent ratiocinative combinatory logic for the purpose of eliminating supernumeraries. The novel breech and chamber beam, that superimposes subordinate beams and facers, has great potential and wide commercial value in many forms.

With the world population increasing rapidly, sheltering humanity is a problem around the globe. Populations are being displaced, and therefore inhabiting areas of the globe, where floods, hurricanes, tornadoes, earthquakes, and warring factions evoke inhospitable conditions. This invention is aimed at easing that problem, as it offers solutions for hurricane proof and earthquake resistant housing, while seriously reducing variable cost without significantly increasing fixed cost.

This invention offers a simple method of sending relief, to displaced populations, in the form of lightweight yet structurally competent breech and chamber beams that are pre-engineered to subordinate and superimpose the most available building products in the rapid renewal of housing.

Furthermore this invention offers cost reductions, for developed countries, in basic rough frame and sheathing applications for conventional wood framed multi story houses and the like.

This invention and system offer a faster way to employ standard materials in the building of formwork for concrete while reducing man-hours in the installation and removal of said formwork through the significant reduction of supernumeraries and the simplicity of the combinatory logic employed.

This invention is easily produced in scale model for the purpose of offering modeling as an example to help others not schooled in the industrial art of building, understand the process and system of building.

This invention is easily produced in scale models for the purpose of offering toy modeling, for children to assemble and disassemble as a pastime or amusement wherein a child may advance aptitude, hand eye co-ordination and an understanding of building systems that will increase their knowledge of the industrial arts.

Further the invention has wide commercial applications derived from its simplicity of combinatory logic and is capable of providing many beneficial applications, with only the super-ordinate breech and chamber beams needed, to quickly provide removable stages, platforms, barricades, fences, docks, bridges, billboards, observation towers, trailer beds, boardwalks, camp facilities, along with many others, to numerous to mention.

Further objects and advantages of this invention will be apparent from the following detailed description of a presently preferred embodiment which is illustrated schematically in the accompanying drawings.

A BRIEF DESCRIPTION OF THE DRAWINGS

The objectives, features and advantages of the present invention and its application will be more readily appreciated when read in conjunction with the accompanying drawings, in which:

FIG. 14A is a perspective view of back to back subordinate beams within the chambers of a super-ordinate beam of the alternative embodiment.

FIG. 14B is a perspective view of face to face subordinate beams within the chambers of a super-ordinate beam of the alternative embodiment.

A DETAILED DESCRIPTION OF THE PREFERRED EMBODIMENT

Figures 1, 2:
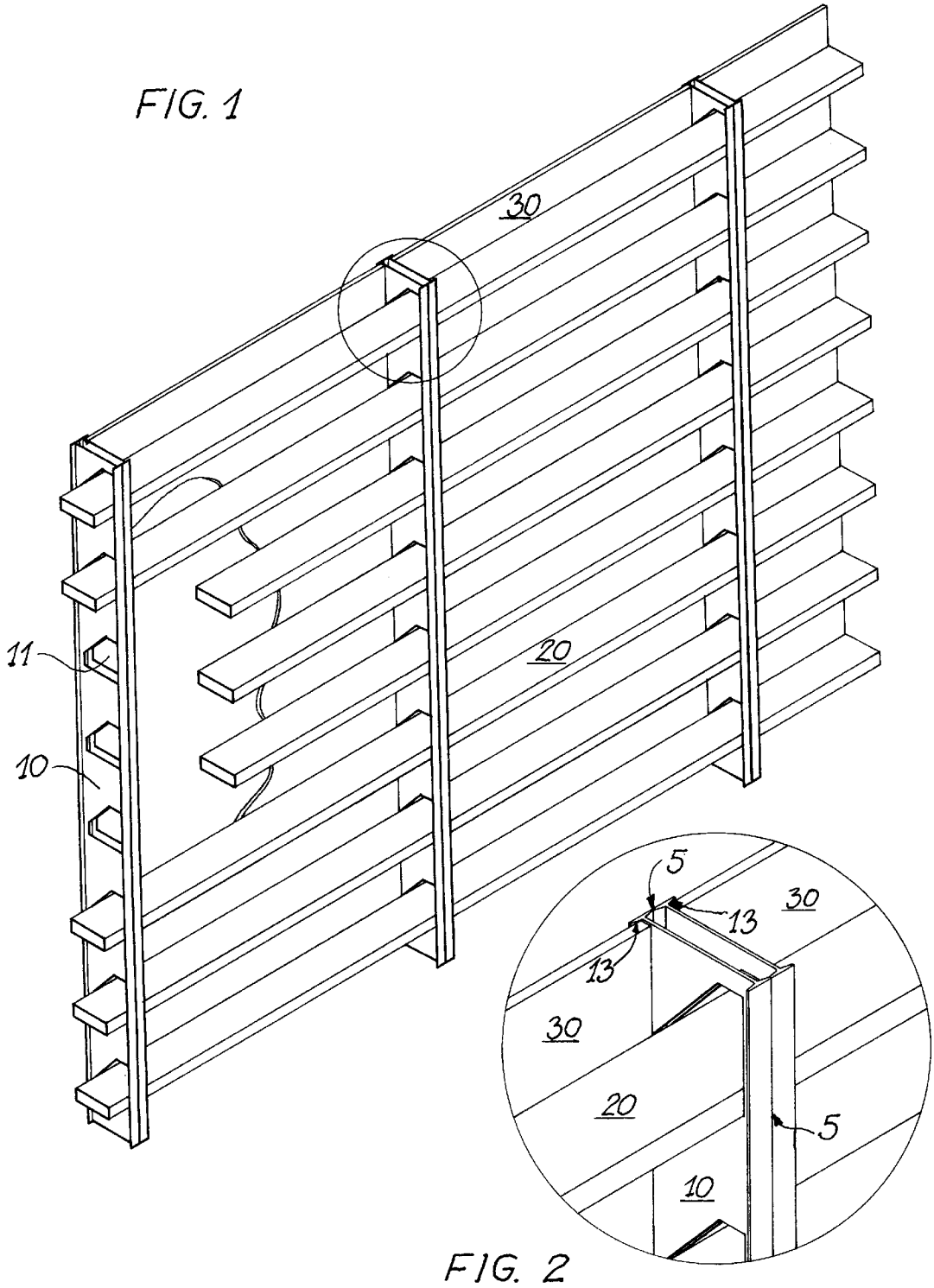
FIG. 1 is a perspective view of the back of a section of an assembled barrier, as detailed in the preferred embodiment.
FIG. 2 is a perspective view of the manufactured super-ordinate II-beam end, the sub-ordinate beam in chamber, and abutting modular facers bridged by the super-ordinate II-beam face flanges.

The Sub-Rigid Fast-Form Barrier System, disclosed herein, is remarkable in its simplicity and promises wide commercial application as the labor costs for construction become increasingly prohibitive.

In the world today time is money and the erection speed this system offers may well revolutionize conventional "post and beam" framing while transforming platform framing to a fast-form barrier system.

The invention is specifically aimed at calculated beam loading where barriers may be economically fabricated to withstand hurricane force winds. While the tie down system for housing walls and roofs is nothing novel, the tie-downs in concert with this fast-form system offers an economical composition that can easily increase or decrease the size of tys to meet estimated standard or eccentric loading. The fast-form system will offer insurance companies an insurable building procedure for any and all applications. When the barriers disclosed herein are utilized as concrete formwork, contractors will have a new option that embraces standard building products, products that may be assembled in half the time of the systems that precede it, with the beauty of employing products that are readily available.

The combinatory logic of this invention dictates what elements will best complete a specific barrier. The invention exploits the latent multi-functional capabilities of each structural element in order to eliminate unnecessary cubic content and supernumeraries that are standard to the art of building barriers such as house floors, walls and roof. Extensive patent searches, both national and international, reveal no such sub-rigid barrier system or systems employing standard building components that are free of fasteners. The preferred embodiment features three basic components, all standard to conventional construction, however the steps taken in this invention reshape some of the standard components, in a way that has not previously been implemented or displayed, in basic barriers such as building floors, walls, roof, and the like.

The elongated multi-functional super-ordinate beams, offer a novel feature, which may be fashioned from steel, aluminum, plastic, plywood, or any other structural material. The super-ordinate beam invention, that orders standard subordinate beams and modular facers into a sub-rigid barrier fabrication, dominates the framework of the preferred embodiment. The super-ordinate beams of the preferred embodiment, comprise webs and flanges but may be tubular or box shaped and according to loading requirements they, may be manufactured as single beams or composite identical beams of two or more. The super-ordinate beams are manufactured with penetrations, through the web portion, the design of these penetrations is the basis for the novel super-ordinate beam and the novel fast-form system. Beam web penetrations act as nodes, designed to easily integrate smaller and lighter transverse subordinate beams, which interlock and act in concert with super-ordinate beams to arrest and sheath modular facers. The super-ordinate beams separate and bridge adjacent modular facers and further said beams may protrude above the facers, as in the preferred embodiment, or they may form a flat continuous plane, flush with modular facers. The invention is designed to be sub-rigid yet static without the need of nails, screws, bolts or other standard fasteners, however fasteners may be employed if so desired and thereby provide a rigid barrier. The barrier thus formed is easily assembled, easily adjusted, and easily disassembled.

Other inventions and conventional systems researched, indicate many novel methods, generally embodying complicated extrusions and the like, with a miriad of interlocking systems that lack simplicity. Furthermore, most inventors have concentrated on novel beam attachments to meet market demands. The research revealed no barriers claimed as sub-rigid or acting as sub-rigid, specifically for the extreme loading applications that the invention herein is designed to handle.

Architects, Engineers, and Designers, historically steer away from penetrating beam webs and generally employ a rule of thumb that allows the removal of no more than one third of a beams width. Following this rule of thumb the invention herein pushes the conventional envelope. By doubling lightweight beams and advancing beam compositions, the strength required for the barriers claimed herein is insured and enhanced, through the computer based ratiocinative process implemented in the design stage.

The novel penetrations previously mentioned, designated as breech and chamber openings, offer a useful new phenomenon that will enjoy continued improvements in the future. Breech and chamber beams have the potential to proliferate the construction market as stronger, lighter, and more durable, elements become available. The patent this application seeks will insure the future of breech and chamber beams and the system they promote. The following descriptions will further disclose the advances this invention offers.

The Sub-Rigid Fast-Form Barrier System of this invention introduces a new way of framing and sheathing a variety of surfaces. The new system includes, calculus for design and determination of structural elements, elements that may be manufactured from; wood, steel, aluminum, plastic, or any other structural material and said elements may have variations of parameters and/or cubic content.

Those elements chosen for the preferred embodiment have specific attributes, attributes derived from calculus of individual parameters and calculus of cubic content, for charting beam load capacities.

As shown in the drawings like numerals represent like parts throughout the various views and the following description will be clear with reference to the drawing figures and views as numbered in the description.

There is generally disclosed in FIG. 1 a portion of an assembled vertical barrier, displaying the preferred embodiment.

The barrier comprises a plurality of identical, elongated, multi-functional, super-ordinate beams 10 arranged in parallel segments.

The super-ordinate beams 10 are manufactured from standard I beams then doubled (II) for the preferred embodiment, said II-beams may be hot formed steel beams known as junior beams.

Said junior beams, as in FIG. 2, are doubled by welding the seam where flanges abut, thereafter the midpoint 5, of said double beams.

Prior to welding, said beams are individually preformed with each embodying a symmetrical series of identical openings 11, slit through the web portion of said I-beams, manufactured employing standard machining techniques.

Said openings 11 each form an identical breech and chamber 11.

The symmetrical series of breech and chamber openings 11 are located a distance, from the inner flange surface 13 of said II-beams 10, said distance assimilates the thickness of the modular sheathing facers 30.

Said breech and chamber openings 11, in series, are preformed wherein opening perimeter dimensions are ratiocinative to smaller and lighter elongated subordinate beams 20, Said subordinate beams 20 are standard lumber 2×6 beams (actual 1.5"×5.5") for the preferred embodiment.

Said subordinate beams 20, perpendicular to and within said beams 10, interlock said series of breech and chamber openings 11, while spanning through two or more laterally spaced beam 10 segments, Said breech and chamber openings 1, form an irregular pentagon.

Figure 6:
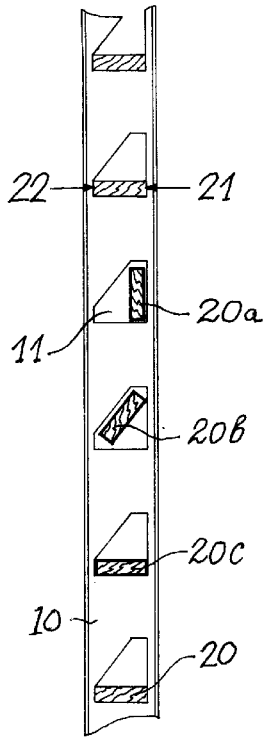
FIG. 6 is a side-view of a super-ordinate beam, with subordinate beams displayed within breech and chamber openings, in various stages of the interlocking procedure.

Said breech portion, calculated and designed marginally larger than said subordinate beams 20, allows subordinate beams 20 to pass freely through the breech of adjacent super-ordinate beams 10, also when the barrier is employed in a vertical application, as in FIG. 1, the subordinate beams 20 will be standing on edge 20*a*, in the breech, wherein they may be horizontally manipulated, lengthwise, into a desired location, prior to invert-ably interlocking, whereupon said standing 20*a* subordinate beam 20, when located, may be force-ably while systematically inverted 90°, as in FIG. 6, into said chamber portion, moreover this requires manipulated inverted rotation 20*b* on a sliding axis.

Upon completion of interlocking procedure, subordinate beam 20 is thus interlocked 20*c* with said chamber portion of super-ordinate beam 10, as said chamber portion is calculated and designed marginally smaller than said subordinate beam 20, and further ratiocinative calculation and design requires the bottom 21, see FIG. 6, of subordinate beam 20 to be cramped into the web portion of said beams 10, while the top 22 of subordinate beam 20 is compressed superjacent to the back of the facer 30, in doing so said facer 30 is consequently compressed superjacent against the inside of flanges 13 of adjacent beams 10, thereby said facer 30 is sheathed within the confines established through the systematic interlocking fast-form beam procedures.

The lateral spacing of super-ordinate beams 10 may be determined by the width of said modular facers 30, whereas elongated butt edges of said facers 30 are abutted against webs of said lateral spaced beams 10, while elongated facer edges 30 are arrested against said inner flange 13 of said II beams 10.

The sub-rigid barrier FIG. 1, thus assemble, offers a static flat plane, with slight protrusions where the front face of flanges 13 of super-ordinate beams 10, bridge and separate the major facers 30, whereupon calculated loads may be applied.

Figure 3:
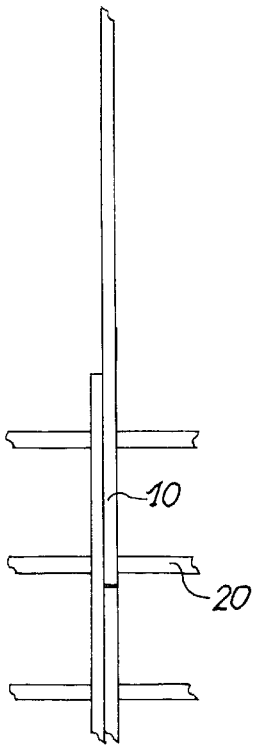
FIG. 3 is an elevation of a super-ordinate beam face depicting a double II-beam lap-splice.

The sub-rigid barrier FIG. 1 thus assembled, is free of supernumeraries such as nails, screws, bolts, or the like and a sub-rigid barrier, thus assembled, may be extended interminably in a lateral or longitudinal direction by alternating joints of adjacent super-ordinate beam members 10, as in FIG. 3, and subordinate beam members 20.

Figure 4:
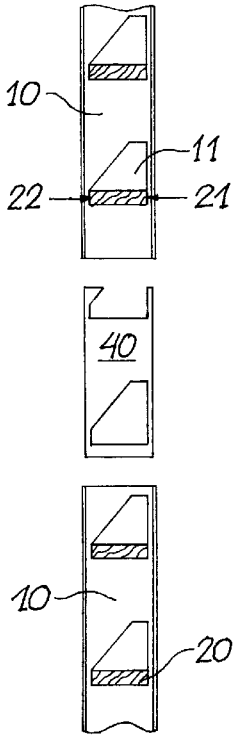
FIG. 4 is a side-view of a box splice, prior to splice insertion, separating super-ordinate beam elements to be joined by said splice.
Figure 5:
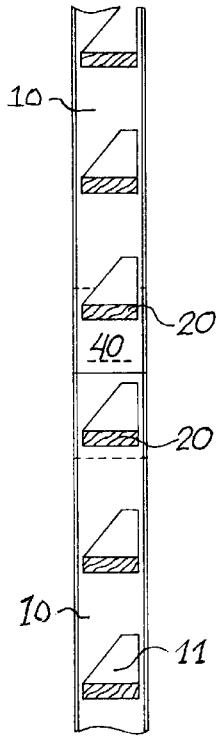
FIG. 5 is a side-view of super-ordinate beam elements in FIG. 4, locked together with the box splice of FIG. 4 hidden within.

FIG. 4 and FIG. 5 offer an alternative method for extending the preferred embodiment in a vertical direction. FIG. 4 displays a box splice 40 positioned between the top of one super-ordinate beam 10 and the bottom of another beam 10, said box splice 40 is manufactured to box parameters that assimilate but are marginally smaller than the opening defined in the top center portion of the super-ordinate II-beam 10, as shown in FIG. 2, and further said box splice contains an opening and a portion of an opening that are sized to match the breech and chamber openings of super-ordinate beams 10.

FIG. 5 displays box splice 40, in its assembled employ, whereby the super-ordinate beams 10, of FIG. 4, are abutted, thereby superimposing box splice 40, and fastened together by systematically interlocked subordinate beams 20.

Figure 9:
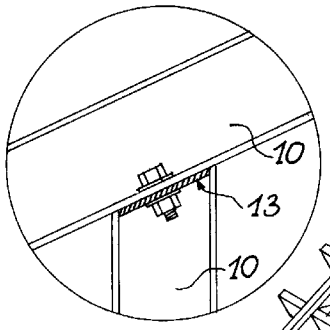
FIG. 9 is a side view, of a super-ordinate beam through-bolt, with a connection to the foundation.
Figure 7:
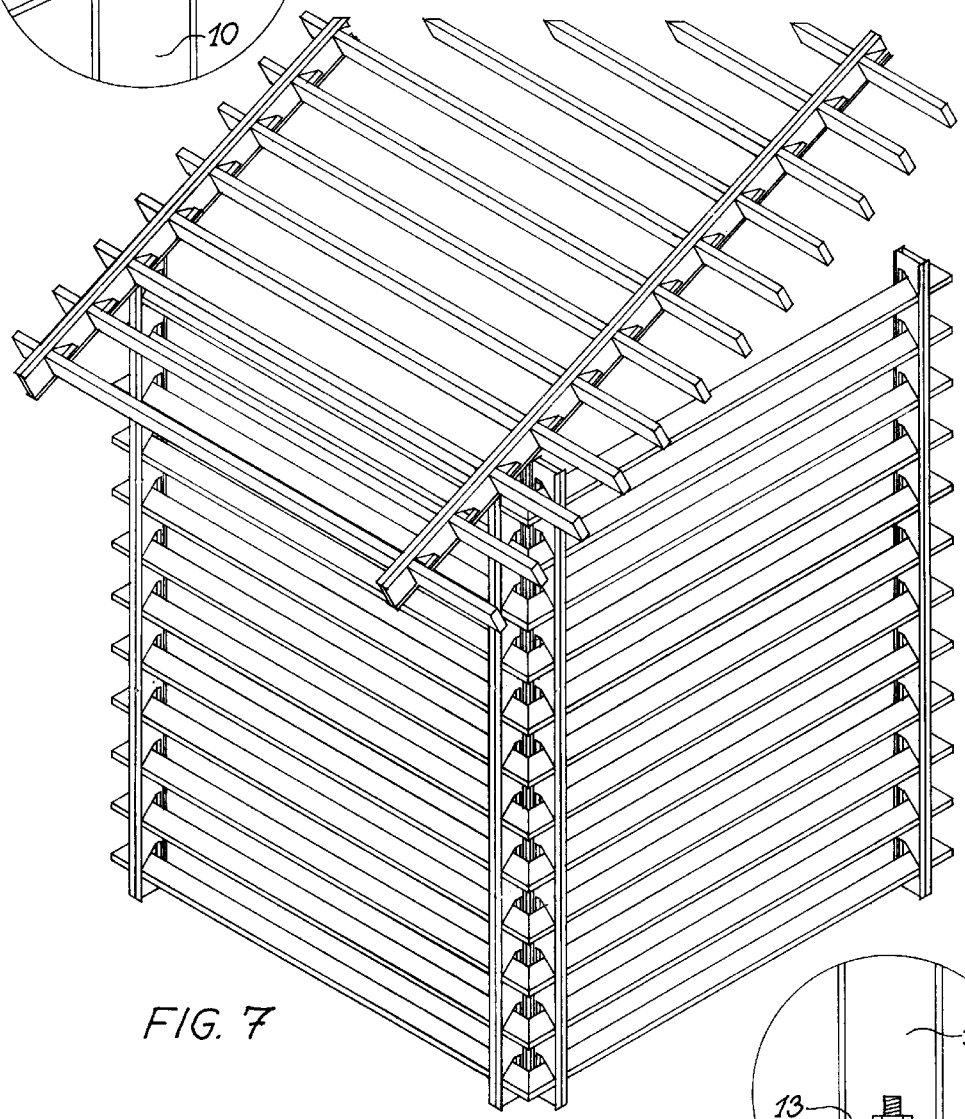
FIG. 7 is a perspective view of an assemblage of barrier frames (excluding facers) in the form of a building including walls and roof.
Figure 8:
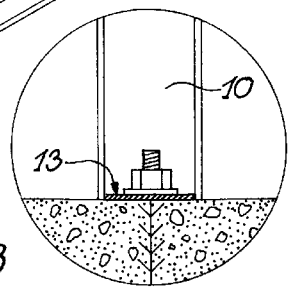
FIG. 8 is a side view of a super-ordinate beam with a through-bolt and its connection to a crossing similar beam.

FIG. 7 displays barrier walls and roof while FIG. 8 and FIG. 9 display standard methods of connection.

Figure 10:
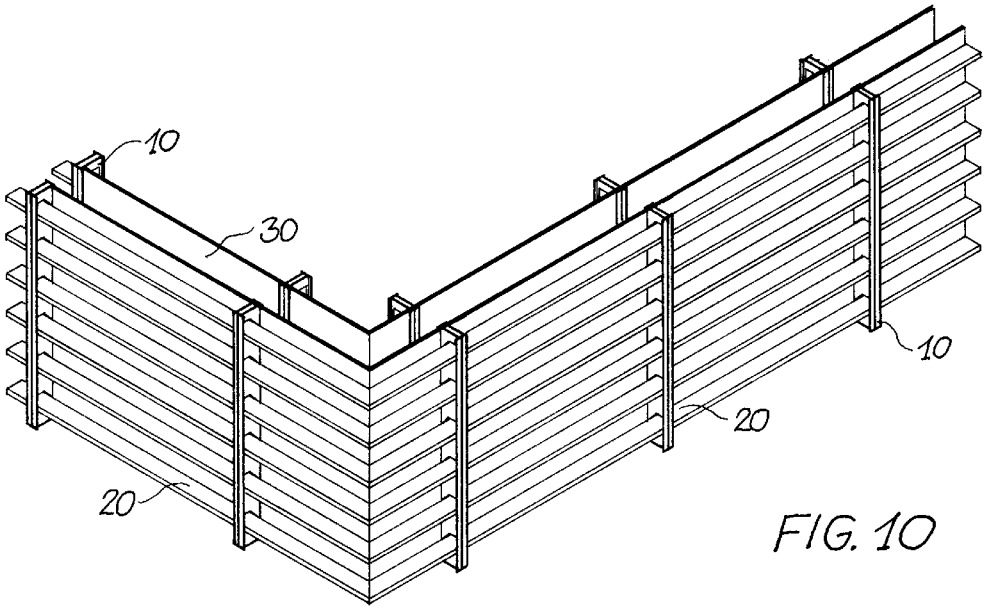
FIG. 10 is a perspective view of barrier sections assembled as forms for concrete wall installations.

FIG. 10 displays barriers employed as formwork for concrete.

Figure 12:
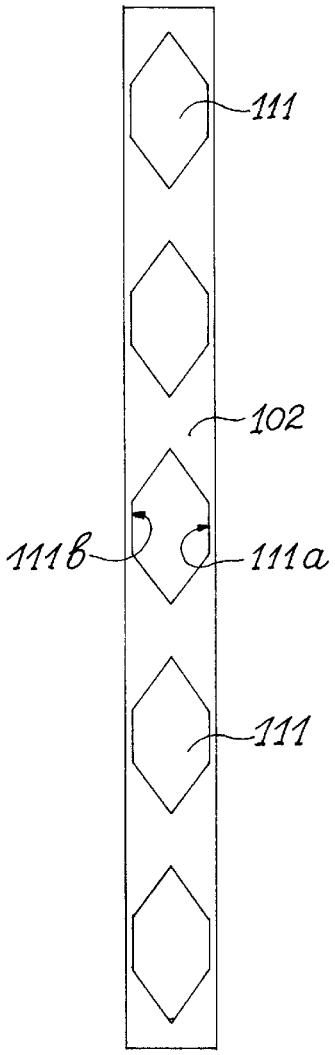
FIG. 12 is a perspective view of a side plate for the super-ordinate beam of the alternate embodiment.
Figure 13:
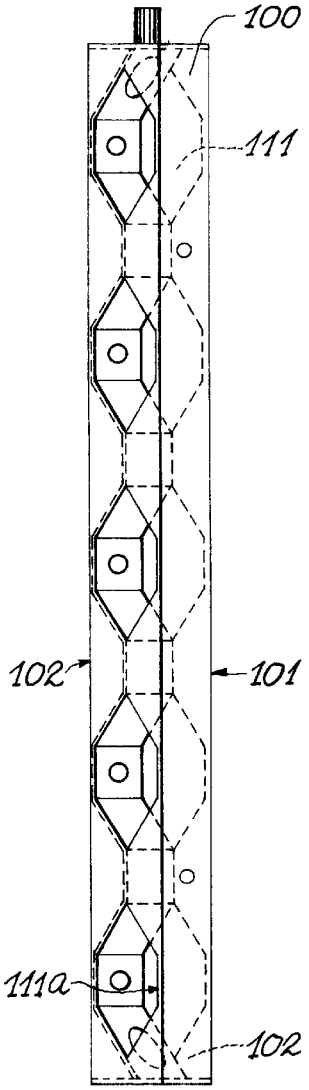
FIG. 13 is a perspective view of a super-ordinate beam of the alternate embodiment.
Figures 14, 15:
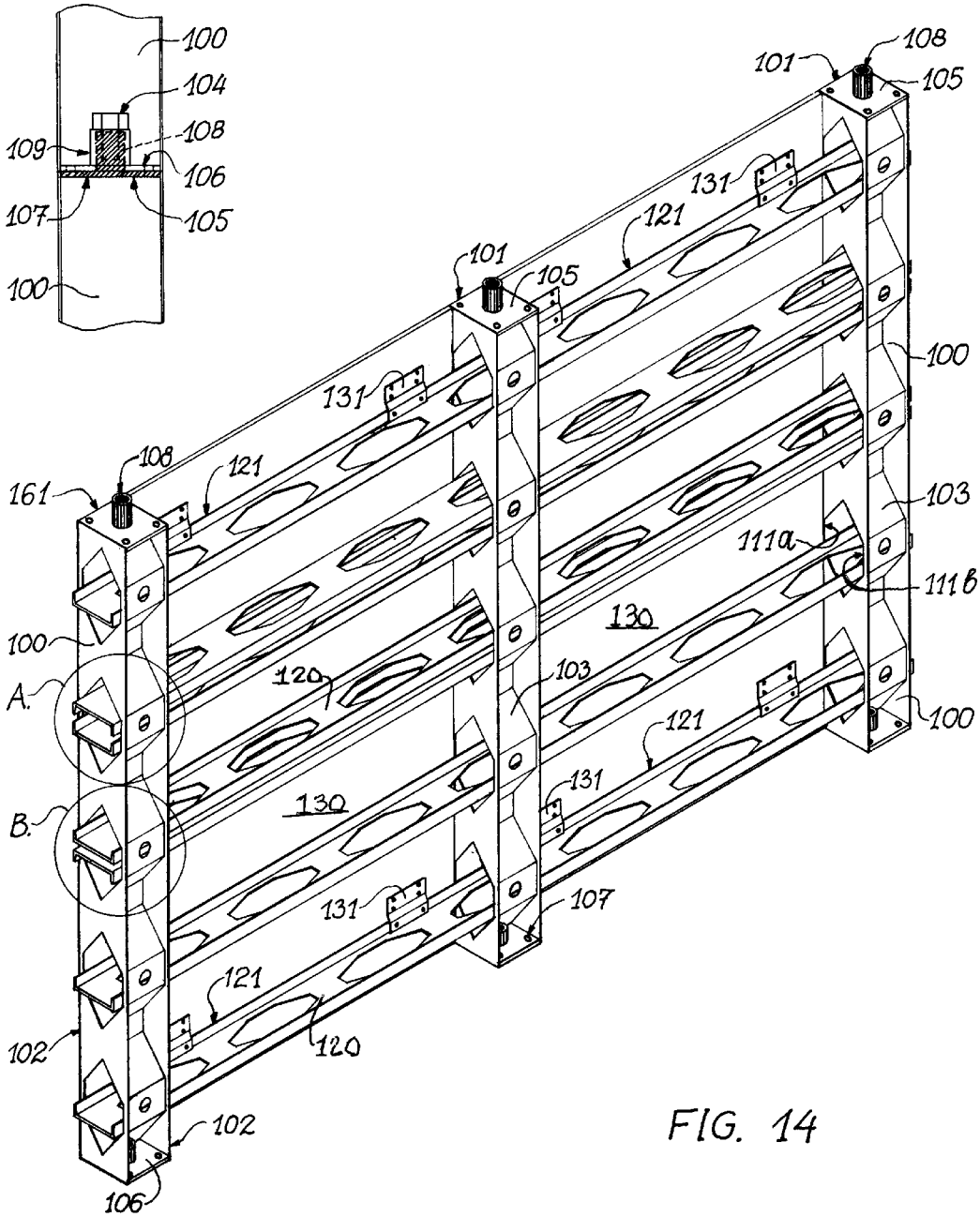
FIG. 14 is a perspective view, from the back of a barrier section, as detailed in the alternate embodiment.
FIG. 15 is a sectional view of the coupling and sleeve joint that occurs when super-ordinate beams of the alternate embodiment are extended.

An alternative embodiment of the Sub-Rigid Fast-Form Barrier System employs calculus of structural elements in order to meet required design specifications, said elements may have variations of parameters, and/or cubic content. Ratiocinative combinatory logic, integral to said invention, explores latent capabilities of elements for derivation of function, said elements for the alternative embodiment herein comprise;

A plurality of identical elongated super-ordinate three sided box ⌈⌉-beams 100, as shown in FIGS. 13 & 14, whereby the sides 102, FIG. 12, of said box beams 100 are generally wider than the face 101 and the open back-space of box beams 100, Box beams 100 are manufactured from preformed structural plates, and said structural plates may be steel, aluminum, plywood or any other structural element.

Figure 11:
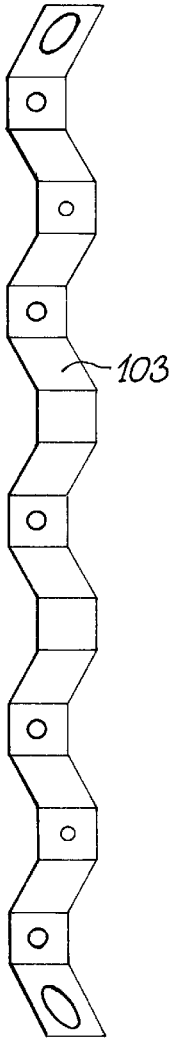
FIG. 11 is a perspective view of a reinforcing plate for the super-ordinate beam of the alternate embodiment.

Box beams 100 comprise a face plate 101 dividing and fronting two identical side plates 102, attached by welds or screws or other standard fastening methods, said side plates 102 are separated and reinforced by a zigzag plate 103, FIG. 11, said zigzag plate 103 follows the shape of the breech and chamber openings 111.

Ends of the box beams 100 are finished with end plates 105 and 106, FIG. 15.

End plate 105 is fabricated with a threaded male coupling 108, welded in a hole, in the center.

End plate 106 is pre-fabricated with a female sleeve 109, welded in a hole in the center, designed to receive the ratiocinative male coupling 108, said end plates 105 and 106 each feature four identical small holes 107.

Holes 107 may be implemented for standard bolt up assembly when box beams 100 are extended. Further said holes 107 may be used for anchor bolts where the super-ordinate beam 100 attaches to a deck or wall.

Coupling 108 and sleeve 109 attachments allow super-ordinate beams 100 to be extended interminably (see FIG. 14 & 15), also couplings 108 may act as lifting points for pre-fabricated barriers that are to be set with hoisting equipment, and further the sleeves 109 (see FIG.) may receive similar couplings at the foundation for a building employing the embodiment herein.

The side plates 102, are preformed with a symmetrical series of alike openings 111, FIG. 12, said openings 111 are precisely machined and said openings 111 each form an identical breech and chambers opening 111, and said symmetrical series of breech and chamber openings 111 are located, a calculated distance, from the face of the box beam 100, said distance extends to the chamber topside 111*a*, said chamber topside being parallel with said face of box beam 100, and said distance assimilates the thickness of modular sheathing facers 130.

The breech and chamber openings 111, in symmetrical series, are preformed wherein opening dimensions are calculated to assimilate, smaller and lighter, subordinate beam size 120, and said openings 111 may be elongated six sided openings shaped with identical A shapes, forming breech portions, at each end, separated by an open box [ ] shape thereby forming the chamber portion of the opening 111, and calculated in a way that allows subordinate beams 120 to be doubled within the chamber delineated by walls (top) being 111*a* and (bottom) being 111*b*.

The doubling of subordinate beams 120 generally occurs in formwork applications where face loading is extreme and beam spacing need be substantially closed in order to reduce facer 130 deflection.

Subordinate beams 120 traverse said openings 111 freely when the width of the subordinate beam 120 is in line with the apex of opposing A shaped breech ends of the opening 111, and subordinate beams 120 may be located and arrested within the super-ordinate beam 100 and may be force-ably rotated, on a sliding axis, and flexed into the chamber portion of said openings 111 therein compressed in a super-incumbent manner within and between chamber top 121 and chamber bottom 122 of said super-ordinate beams 100.

The novel design of the breech and chamber openings 111 , with two such openings 111 cooperating at each intersection, with said intersection/s in series along each super-ordinate beam 100, allowing the subordinate beams 120 the options of; being installed back to back as in FIG. 14(B) or being installed face to face as in FIG. 14(A).

Subordinate beams 120 may abut each other within the parameters of the super-ordinate beam 100, or abut between super-ordinate beams 100, or overlap each other within or between super-ordinate beams 100.

Subordinate beams 120, perpendicularly traverse super-ordinate beams 100, and mate the series of openings 111 therein, and beams 120 span two or more laterally spaced super-ordinate beams 100.

Lateral spacing of super-ordinate beams 100 may be determined by the width of said facers 130, whereby elongated edges of said facers 130 are abutted against the sides 102 of said laterally spaced box ⌈⌉-beams 100.

Facers 130 are equipped with, ratiocinative retainers 131, attached on the backside of said facers 130, and said retainers 131 are located to overlap and mate flanges 121 of subordinate beam 120, for quick assembly and disassembly, and said facers 130 are multi-functional whereby the width of said facers 130, space box beams 100 and, laterally brace box beams 100 while the entire facer 130 stabilizes subordinate beams 120, while supporting face loading, and supporting axial loading if so designed.

Subordinate beams 120 may pass freely through said breech until arriving at pre-engineered locations whereby they are invert-ably and force-ably manipulated from standing in the breech position to being compressed between chamber top and bottom.

Therefore when said subordinate beams 120 are locked into their designed location and said facers 130 are attached to said subordinate beams 120 an alternate embodiment of the fast-form barrier is complete.

The inventor has given a non-limiting description of the preferred and alternate embodiments. Many changes may be made to this design without deviating from, the spirit of the concept of this invention. Examples of such contemplated variations include the following.

a.) The inventor has disclosed two shapes of breech and chamber openings in the super-ordinate beam members, while many alternative shapes will be employed with equal facility and effectiveness.

b.) The inventor has disclosed two shapes of super-ordinate beams, while many alternative shapes may be employed for applications requiring various specifications for beam loading, beam elements, beam design, beam parameters, as well as other engineering considerations for structural beams.

c.) The inventor has disclosed two shapes of subordinate beams used in the sub-rigid fast-form barrier system, while many alternative elements shapes and compositions may be employed as subordinate beams for said barrier system.

d.) The concept may be extended into other applications not specifically enumerated in this disclosure.

Other changes, such as aesthetic considerations and substitution of newer materials as they become available, may be made, which substantially perform the same function in substantially the same manner with substantially the same result without deviating from the spirit of this invention.

While this invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What I claim as my invention is:

1. A ratiocinative, interlocking, Sub-Rigid Fast-Form Barrier System, comprising:

a.) a plurality of manufactured, identical, elongated, ratiocinative, super-ordinate beams spaced in adjacent lateral segments, and said beams, configured as double II-beams, each having a double web and a front (or top) and a back (or bottom) flange, and said II-beams having an identical symmetrical series of machined openings, through each single I-beam, and said openings aligning within said double II-beams, b.) at least two elongated ratiocinative subordinate beams, passing through said super-ordinate beam openings, in a transverse series, said openings providing an interlock-able intersection for said subordinate beams; and further said openings are each identically preformed in an irregular pentagon shape therein providing "breech and chambers" for said subordinate beams, said breech is calculated and designed for free transverse passage of subordinate beams, said breech portion of said openings assimilating and machined marginally bigger than the cross-sectional parameters of said subordinate beams; and further said chamber portion of said openings calculated and designed to cramp subordinate beams within, when said subordinate beams are forcefully, while systematically, inverted 90° from said breech to said chamber, thereupon interlocked in said chambers, as said chambers are preformed, assimilating and machined, a dimension marginally smaller than the width of said elongated subordinate beams;

c.) at least one modular facer, secured firmly between said adjacent super-ordinate beams, said facers elongated butt edges butt against the webs of said adjacent super-ordinate beams, and said facers, elongated face edges, arrest against the inside of said front/face flanges of adjacent super-ordinate beams, and said front/face flanges separate and bridge adjoining modular facers;

d.) a plurality of said breech and chamber openings in said symmetrical series, said series of openings having a front/face chamber wall and a back chamber wall parallel with said front/face chamber wall, and further said front/face wall is located and machined, a dimension, from the inside surface of said front/face flange, said dimension assimilating while marginally less than the thickness of said modular facer;

e.) a compressed superjacent fit for said modular facer or facers, sheathed and systematically locked, between said front/face flange of said super-ordinate beam and the face edge of said subordinate beam, when said subordinate beam is systematically inverted 90°, into said chamber, thereupon systematically interlocked and cramped into said back chamber wall, thereupon completing assembly of a Sub-Rigid Fast-Form Barrier System.

2. The ratiocinative, interlocking, barrier system of claim 1, whereupon ratiocinative combinatory logic may be employed to determine;

a.) the elements of said super-ordinate beams, said elements are selected from one of: steel, aluminum, fiberglass, plywood, plastic, b.) the parameters of said super-ordinate beam, and c.) the cubic content of said super-ordinate beam.

3. A ratiocinative, interlocking, barrier system, according to claim 1, whereupon said super-ordinate beams are delineated and employed in said barrier system as single structural I-beams.

4. The barrier system of claim 1 whereupon the super-ordinate beams, with breech and chamber openings, are delineated as multiple structural I-beams manufactured and incorporated as double II-beams.

5. The ratiocinative, interlocking, barrier system of claim 1 whereupon super-ordinate beams may be extended by employing a box type splice appurtenance;

a.) said box splice appurtenance being ratiocinative to super-ordinate beam elements, parameters, and cubic content, and b.) said box splice employing at least two, full or partial, breech and chamber openings in a series, identical to super-ordinate beam breech and chamber openings, and c.) said box splice exterior parameters, assimilating the enclosure formed when manufacturing composite multiple beams, d.) said box splice, when inserted in the top end of super-ordinate beam A, to a point, when at least one box splice breech and chamber opening aligns within the first breech and chamber opening in said super-ordinate beam A, being systematically interlocked within said top end of said super-ordinate beam A, and said box splice now acting as a male receptor receiving the bottom end of super-ordinate beam B, said super-ordinate beam B sleeved over said box splice, interlocked within the top of super-ordinate beam A, until butting said top of said super-ordinate beam A, at which point a breech and chamber opening, or a partial breech and chamber opening, in said box splice aligns with the bottom breech and chamber openings in said bottom end of said super-ordinate beam B, thereby allowing said super-ordinate beam B to become an extension of super-ordinate beam A when a sub-ordinate beam is interlocked within the aligning breech and chamber openings of the box splice and super-ordinate beam B.

6. The barrier system of claim 1 wherein said subordinate beams remove-ably interlock with said super-ordinate beams.

7. The ratiocinative, interlocking, Sub-Rigid Fast-Form Barrier System, according to claim 1, whereupon ratiocinative combinatory logic may determine said subordinate beams to be any structural material selected from at least one of: steel, aluminum, fiberglass, plywood, lumber, or plastic.

8. The ratiocinative, interlocking, Sub-Rigid Fast-Form Barrier System, according to claim 1, whereupon the series of breech and chambers openings may be machined in any super-ordinate beam that conforms to the essence of the invention.

9. A ratiocinative, interlocking, barrier system, according to claim 1, whereupon said series of breech and chambers openings in said super-ordinate beams may be machined in alternative forms, provided said forms conform to the essence of the invention.

10. A ratiocinative, interlocking, barrier system, according to claim 1, whereupon said barrier system is employed as a vertical interior or exterior wall for a multistory building.

11. A ratiocinative, interlocking, barrier system, according to claim 1, whereupon said barrier system, is employed as a vertical interior or exterior wall with said super-ordinate beams assembled horizontally with subordinate beams interlocked in a vertical position.

12. The ratiocinative, interlocking, Sub-Rigid Fast-Form Barrier System, according to claim 1, whereupon the barrier system is employed as a rigid system, with fasteners as needed.

13. A ratiocinative, interlocking, Sub-Rigid Fast-Form Barrier System, fabricated according to claim 1, whereupon said barriers are arranged and joined together as a scale model sub-rigid building that may be implemented as a toy house or the like.

14. A ratiocinative, interlocking, Sub-Rigid Fast-Form Barrier System, fabricated according to claim 1, whereupon barriers are employed as opposing barrier walls, for an enclosed concrete form system wherein:

a.) said super-ordinate double II-beams, are machined, with ratiocinative form-tie holes drilled through the center, and said holes located along the seam where abutting flanges weld together;

b.) said super-ordinate beams are stationed opposite each other, along said opposing barrier walls, and therefore ties may be installed and secured in order to hold said opposing barrier walls in a desired location during placement of liquid concrete.

15. A ratiocinative, interlocking, Sub-Rigid Fast-Form Barrier System, fabricated according to claim 1, wherein said barrier is employed as a fence with:

a.) said super-ordinate beams embedded in the earth as fence posts;

b.) the inclusion of the facer optional.

16. A ratiocinative, interlocking, Sub-Rigid Fast-Form Barrier System, fabricated according to claim 1, wherein said barrier is employed as a vehicular trailer bed, with standard; axles, springs, and draw bar or fifth wheel, added.

17. The ratiocinative, interlocking, barrier system of claim 1 herein said elongated multiple super-ordinate beams are of increased beam depth;

said increased beam depth dimensioned, from the back of the breech and chamber opening to the back flange of the super-ordinate beam, a measurement that assimilates the parameters of infrastructure elements, said elements may be in the form of drainpipes, said elements may be in the form of water pipes, said elements may be in the form of wiring for phones, computers, or electrical installations, said elements may be in other forms.

18. An interlocking barrier system comprising:

superordinate beams configured as double II-beams with planar faces;

a plurality of irregular shaped openings in the beams, each of the openings having a front face and a back face chamber wall;

subordinate beams with planar faces, being inserted through the double II-beams, wherein a breech portion of each of the openings is greater than a cross-sectional parameter portion of each of the subordinate beams, the subordinate beams being manipulated to a horizontal interlocking position within the openings so that the planar faces of the subordinate beams are ninety degrees to the planar faces of the superordinate beams, and wherein each of the openings allows for cramping each of the subordinate beams therein.

19. The interlocking barrier system of claim 18, wherein the irregular shaped openings in the beams include: irregular pentagon shapes.

20. An interlocking barrier system comprising:

superordinate beams having planar faces;

a plurality of irregular shaped openings in the beams, each of the openings having a front face and a back face chamber wall; and subordinate beams having planar faces with a continuous rectangular cross-section along a longitudinal length of the subordinate beams passing through the openings, wherein a breech portion of each of the openings is greater than a cross-sectional parameter portion of each of the subordinate beams, the subordinate beams being manipulated to a horizontal interlocking position within the openings so that the planar faces of the subordinate beams are ninety degrees to the planar faces of the superordinate beams, and wherein each of the openings allows for cramping each of the subordinate beams therein.

21. The interlocking barrier system of claim 20, wherein the irregular shaped openings in the beams include: irregular pentagon shapes.

22. The interlocking barrier system of claim 20 wherein the subordinate beams each include four planar faces perpendicular to one another, the four planar faces include two narrow width faces and two wide width faces that are wider than the two narrow width faces.

23. A method of forming an interlocking barrier system comprising the steps of:

vertically orienting a pair of superordinate beams apart from one another, the superordinate beams having a plurality of irregular shaped openings therethrough;

positioning subordinate beams at an angle through the irregular shaped openings in the pair of the of the superordinate beams, the subordinate beams each having planar faces with a continuous rectangular cross-section along a longitudinal length of the subordinate beams passing through the openings; and manipulating the subordinate beams to horizontal interlocking positions within the openings.

24. The method of claim 23, wherein the subordinate beams each include four planar faces perpendicular to one another, the four planar faces include two narrow width faces and two wide width faces that are wider than the two narrow faces.

* * * * *